United States Patent [19]

Nathasingh et al.

[11] Patent Number: 5,035,755

[45] Date of Patent: Jul. 30, 1991

[54] AMORPHOUS METAL ALLOYS HAVING ENHANCED AC MAGNETIC PROPERTIES AT ELEVATED TEMPERATURES

[75] Inventors: Davidson M. Nathasingh, Stanhope; Ronald J. J. Martis, East Hanover; Amitava Datta, Morris Township, Morris County, all of N.J.

[73] Assignee: Allied-Signal Inc., Morris Township, Morris County, N.J.

[21] Appl. No.: 627,606

[22] Filed: Dec. 11, 1990

Related U.S. Application Data

[63] Continuation of Ser. No. 384,900, Jul. 24, 1989, abandoned, which is a continuation of Ser. No. 120,242, Nov. 12, 1987, abandoned, which is a continuation of Ser. No. 883,870, Jul. 14, 1986, abandoned, which is a continuation of Ser. No. 641,145, Aug. 16, 1984, abandoned, which is a continuation of Ser. No. 613,118, May 23, 1984, abandoned.

[51] Int. Cl.[5] ..... C22C 38/02

[52] U.S. Cl. ..... 148/304; 148/307; 420/117; 420/121

[58] Field of Search ..... 148/304, 307; 420/121, 420/117

[56] References Cited

U.S. PATENT DOCUMENTS

| | | | |
|---|---|---|---|
| 3,856,513 | 12/1974 | Luborsky et al. | 148/304 |
| 4,409,041 | 10/1983 | Datta et al. | 75/123 L |
| 4,437,907 | 3/1984 | Sato et al. | 75/123 B |

FOREIGN PATENT DOCUMENTS

| | | | |
|---|---|---|---|
| 0058269 | 3/1983 | European Pat. Off. . | |
| 2915737 | 11/1979 | Fed. Rep. of Germany | 75/123 B |
| 59-25955 | 2/1982 | Japan | 75/123 B |

OTHER PUBLICATIONS

Mitchell et al., "E Effect & Magnetomechanical Coupling Factor in $Fe_{80}B_{20}$ and $Fe_{78}Si_{10}B_{12}$ Glassy Ribbons", Transactions on Magnetics, vol. Mag-14, No. 6, Nov. 1978, pp. 1169-1171.

*Primary Examiner*—Deborah Yee
*Attorney, Agent, or Firm*—Gus T. Hampilos

[57] ABSTRACT

An amorphous metal alloy which is at least 90% amorphous having enhanced magnetic properties at elevated temperatures and consisting essentially of a composition having the formula $Fe_aSi_bB_c$ wherein "a", "b" and "c" are atomic percentages ranging from about 79.4 to 79.8, 6 to 8 and 12 to 14, respectively, with the proviso that the sum of "a", "b" and "c" equals 100.

6 Claims, 2 Drawing Sheets

AMORPHOUS METAL ALLOYS HAVING ENHANCED AC MAGNETIC PROPERTIES AT ELEVATED TEMPERATURES

CROSS REFERENCE TO RELATED APPLICATIONS

This application is a continuation of application Ser. No. 384,900 filed July 24, 1989, a continuation of Ser. No. 120,242, filed 11/12/87, a cont. of Ser. No. 883,870 filed 7/14/86 a cont. of Ser. No. 641,145 filed 8/16/84 all now abandoned, which is a continuation-in-part of Application Ser. No. 613,118, filed May 23, 1984, now abandoned.

BACKGROUND OF THE INVENTION

1. Field of the Invention

The invention relates to amorphous metal alloy compositions and, in particular, to amorphous alloys containing iron, silicon and boron having enhanced AC magnetic properties at elevated temperatures.

2. Description of the Prior Art

Investigations have demonstrated that it is possible to obtain solid amorphous materials from certain metal alloy compositions. An amorphous material substantially lacks any long range atomic order and is characterized by an X-ray diffraction profile consisting of broad intensity maxima. Such a profile is qualitatively similar to the diffraction profile of a liquid or ordinary window glass. This is in contrast to a crystalline material which produces a diffraction profile consisting of sharp, narrow intensity maxima.

These amorphous materials exist in a metastable state. Upon heating to a sufficiently high temperature, they crystallize with evolution of the heat of crystallization, and the X-ray diffraction profile changes from one having amorphous characteristics to one having crystalline characteristics.

Novel amorphous metal alloys have been disclosed by H. S. Chen and D. E. Polk in U.S. Pat. No. 3,856,513, issued Dec. 24, 1974. These amorphous alloys have the formula $M_aY_bZ_c$ where M is at least one metal selected from the group of iron, nickel, cobalt, chromium and vanadium, Y is at least one element selected from the group consisting of phosphorus, boron and carbon, Z is at least one element selected from the group consisting of aluminum, antimony, beryllium, germanium, indium, tin and silicon, "a" ranges from about 60 to 90 atom percent, "b" ranges from about 10 to 30 atom percent and "c" ranges from about 0.1 to 15 atom percent. These amorphous alloys have been found suitable for a wide variety of applications in the form of ribbon, sheet, wire, powder, etc. The Chen and Polk patent also discloses, amorphous alloys having the formula $T_iX_j$, where T is at least one transition metal, X is at least one element selected from the group consisting of aluminum, antimony, beryllium, boron, germanium, carbon, indium, phosphorus, silicon and tin, "i" ranges from about 70 to 87 atom percent and "j" ranges from about 13 to 30 atom percent. These amorphous alloys have been found suitable for wire applications.

U.S. Pat. No. 4,300,950 discloses amorphous metal alloys consisting essentially of 12 to 15% boron, 1 to 8% silicon and 80 to 84% iron, by atomic percentage. These alloys exhibit relatively low crystallization and curie temperatures (i.e. less than 400° C.). As a result, the magnetic properties thereof are substantially degraded by long term thermal aging, and the induction levels of the alloys are relatively low at elevated temperatures. Hence, the alloys are not well suited for power magnetics applications wherein operating temperatures frequently exceed 100° C.

European Patent Application 095,831, filed Mar. 28, 1983 discloses amorphous metal alloys consisting of 4–10% boron, 14–17% silicon and 73–80% iron, by atomic percentages and incidental impurities. These alloys evidence high exciting power (e.g. of the order of 3–5 VA/kg at 60 Hz and 1.4 T) and are not well suited for power magnetics appliations wherein low exciting power is required.

European Patent Application 095,803, filed Mar. 28, 1983 discloses amorphous metal alloys consisting of 6–10% boron, 14–17% silicon and 1–4% chromium, by atomic percentages, no more than incidental impurities and the balance iron. These chromium containing alloys have relatively low intrinsic saturation induction and relatively low curie temperature, and are unsuitable for elevated temperature, high induction applications.

U.S. Pat. No. 4,437,907 discloses amorphous metal alloys composed of 8–19% silicon, 6–13% boron 0–3.5 carbon and 74–80% iron, by atomic percentage with incidental impurities. These alloys evidence low crystallization temperatures (e.g. less than 515° C.) and, hence, are not well suited for power magnetics applications.

European Patent. Application 0,058,269, filed May 8, 1981 discloses amorphous metal alloys consisting essentially of 12 to 16% boron, 5 to 10% silicon and 77 to 80% iron, by atom percent, with no more than incidental impurities. No disclosure is contained therein concerning alloys which exhibit, in combination, enhanced induction at elevated temperatures and long term thermal stability.

At the time that the amorphous alloys described above were discovered, they evidenced magnetic properties that were superior to then known polycrystalline alloys. Nevertheless, new applications requiring improved magnetic properties at elevated temperatures and higher thermal stability have necessitated efforts to develop additional alloy compositions.

SUMMARY OF THE INVENTION

In accordance with the present invention, there is provided a metal alloy which is at least 90% amorphous consisting essentially of a composition having the formula $Fe_aSi_bB_c$ wherein "a", "b" and "c" are atomic percentages ranging from above about 79.4 to 79.8, 6 to 8 and 12 to 14 respectively, with the proviso that the sum of "a", "b" and "c" equals 100.

The subject alloys are at least 90% amorphous and preferably at least 97% amorphous, and most preferably 100% amorphous, as determined by X-ray diffraction. The alloys are fabricated by a known process which comprises forming a melt of the desired composition and quenching at a rate of at least about $10^5$° C./ sec. by casting molten alloy onto a rapidly rotating chill wheel.

In addition, the invention provides a method of enhancing the magnetic properties of a metal alloy which is at least 90% amorphous consisting essentially of a composition having the formula $Fe_aSi_bB_c$ wherein "a", "b" and "c" are atomic percentages ranging from above about 79.4 to 79.8, 6 to 8 and 12 to 14 respectively, with the proviso that the sum of "a", "b" and "c" equals 100, which method comprises the step of annealing the amorphous metal alloy.

Further, the invention provides a core for use in an electromagnetic device; such core comprising a metal alloy which is at least 90% amorphous consisting essentially of a composition having the formula $Fe_aSi_bB_c$ wherein "a", "b" and "c" are atomic percentages ranging from above about 79.4 to 79.8, 6 to 8 and 12 to 14, respectively, with the proviso that the sum of "a", "b" and "c" equals 100.

The alloys of this invention exhibit improved AC magnetic properties at temperatures ranging from about 100° to 150° C. As a result, the alloys are particularly suited for use in power transformers, aircraft transformers, current transformers, high frequency transformers (e.g. transformers having operating frequencies ranging from about 400 Hz to 100 kHz), switch cores, high gain magnetic amplifiers and low frequency inverters.

BRIEF DESCRIPTION OF THE DRAWINGS

The invention will be more fully understood and further advantages will become apparent when reference is made to the following detailed description and the accompanying drawings in which.

DETAILED DESCRIPTION OF THE INVENTION

Figure 1:
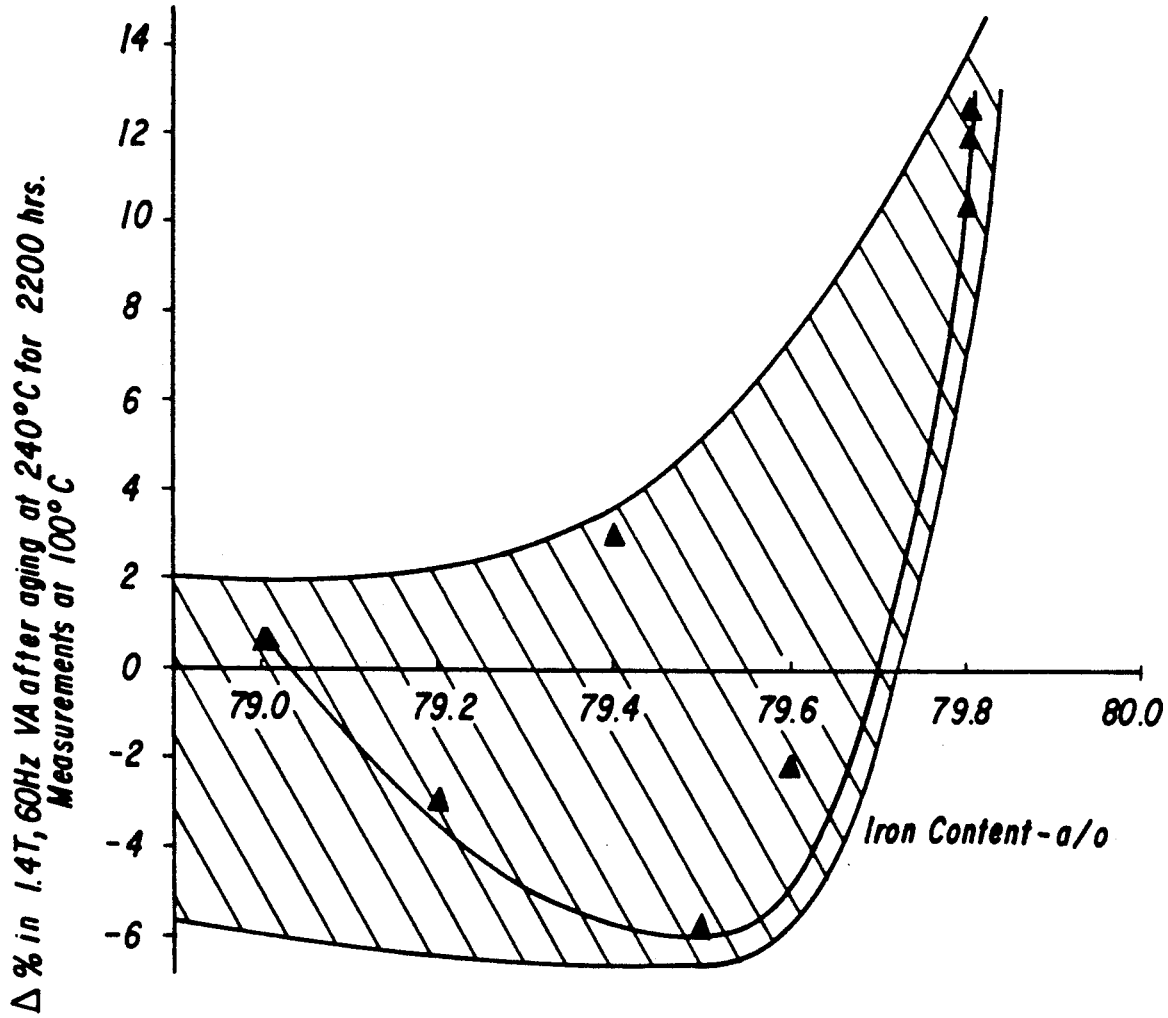
FIG. 1 is graph comparing thermal stability (i.e., percent change in 1.4 T/60 Hz exciting power as a function of iron content) for alloys within and outside the scope of the invention.

The composition of the new amorphous Fe-Si-B alloy, in accordance with the invention, consists of above about 79.4 to 79.8 atom percent iron, 6 to 8 atom percent silicon and 12 to 14 atom percent boron. Such compositions exhibit enhanced AC magnetic properties at elevated temperatures. The improved magnetic properties are evidenced by high magnetization, low core loss and low volt-ampere demand which remain constant and stable at temperatures ranging from about 100° to 150° C. A preferred composition within the foregoing ranges consists of 79.5 atom percent iron, 13 atom percent boron, the balance being silicon.

The alloys of the present invention are at least about 90% amorphous and preferably at least about 97% amorphous and most preferably 100% amorphous. Magnetic properties are improved in alloys possessing a greater volume percent of amorphous material. The volume percent of amorphous material is conveniently determined by X-ray diffraction.

The amorphous metal alloys are formed by cooling a melt at a rate of about $10^{5°}$ to $10^{6°}$ C./sec. The purity of all materials is that found in normal commercial practice. A variety of techniques are available for fabricating splat-quenched foils and rapid-quenched continuous ribbons, wire, sheet, etc. Typically, a particular composition is selected, powders or granules of the requisite elements (or of materials that decompose to form the elements, such as ferroboron, ferrosilicon, etc.) in the desired proportions are melted and homogenized, and the molten alloy is rapidly quenched on a chill surface, such as a rotating cylinder.

The most preferred process for fabricating continuous metal strip containing the alloys of the invention is that set forth in U.S. Pat. No. 4,142,571 to Narasimhan. The Narasimhan patent, which is incorporated herein by reference thereto, sets forth a method of forming a continuous metal strip by depositing molten metal onto the surface of a moving chill body. The method comprises the steps of (a) moving the surface of a chill body in a longitudinal direction at a constant predetermined velocity of from about 100 to about 2000 meters per minute past the orifice of a slotted nozzle defined by a pair of generally parallel lips located proximate to the surface such that the gap between the lips and the surface is from about 0.03 to about 1 millimeter, the orifice being arranged generally perpendicular to the direction of movement of the chill body, and (b) forcing a stream of molten metal through the orifice of the nozzle into contact with the surface of the moving chill body to permit the metal to solidify thereon to form a continuous strip. Preferably, the nozzle slot has a width of from about 0.34 to 1 millimeter, the first lip has a width at least equal to the width of the slot and the second lip has a width of from about 1.5 to 3 times the width of the slot amorphous metal strip produced in accordance with the Narasimhan process has a width of at least about 7 millimeters, preferably at least about 1 centimeter and, more preferably yet, a width of at least about 3 centimeters. The strip is at least 0.02 millimeter thick but may be as thick as about 0.14 millimeter, or thicker, depending on the melting point, solidification and crystallization characteristics of the alloy employed.

The alloys of the present invention have an improved processability as compared to other iron-based metallic glasses, since the subject alloys demonstrate a minimized melting point and maximized undercooling.

The magnetic properties of the subject alloys can be enhanced by annealing the alloys. The method of annealing generally comprises heating the alloy to a temperature sufficient to achieve stress relief but less than that required to initiate crystallization, cooling the alloy, and applying a magnetic field to the alloy during the heating and cooling. Generally, a temperature range of about 340° C. to 440° C. is employed during heating. A rate of cooling range of about 0.5° C./min. to 75° C./min. is employed, with a rate of about 1° C./min. to 16° C./min. being preferred.

As discussed above, the alloys of the present invention exhibit improved magnetic properties (particularly higher saturation induction) that are stable at temperatures ranging from about 100 to about 150° C., rather than a maximum of 125° C. as evidenced by prior art alloys. The increased temperature stability of the present alloys allows utilization thereof in high temperature applications, such as cores in transformers for distributing electrical power to residential and commercial consumers.

More specifically, for the Fe-B-Si compositions disclosed hereinabove, superior loss and exciting power characteristics can be achieved by proper selection of annealing conditions. Apart from loss and exiting power characteristics, two other criteria, namely, saturation induction at elevated temperature and thermal stability are crucial to and should be optimized for power magnetics applications.

Figure 2:
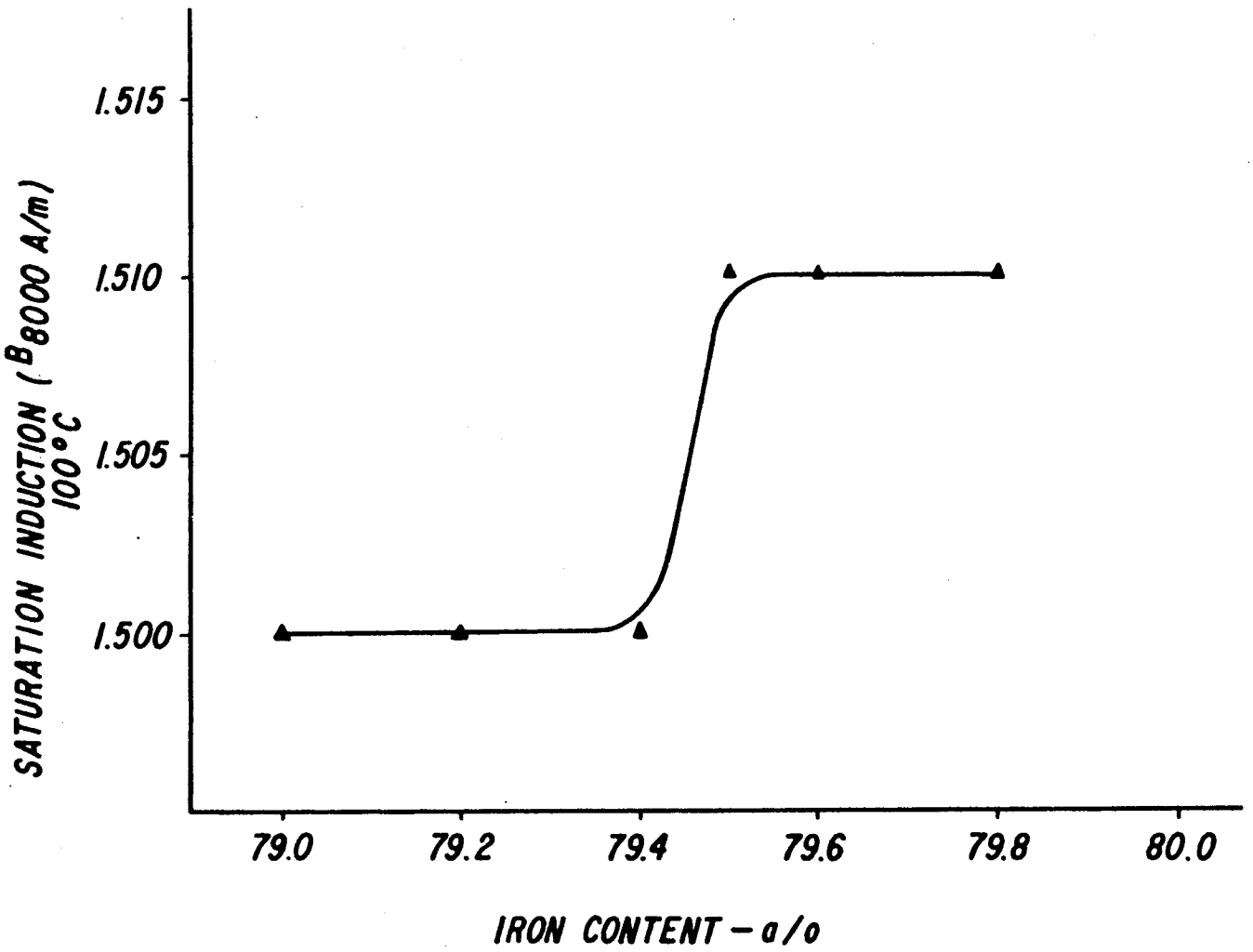
FIG. 2 is a graph comparing saturation induction (i.e., induction measured at 8000 A/m and 100° C.) as a function of iron content for alloys within and outside the scope of the invention.

Saturation induction at elevated temperature can be approximated by measuring B 8000 A/m at 100° C. FIG. 2 is a graph comprising saturation induction (i.e., induction measured at B 8000 A/m and 100° C.) as a function of iron content for Fe-B-Si containing alloys within and outside the scope of the invention. As illustrated by FIG. 2, the saturation induction at 100° C. for alloys containing above about 79.4 atom percent iron is about 1% higher than that of alloys having iron content less than 79.4. From the standpoint of loss evaluation, this gain in operating induction at elevated temperature decreases the size of the transformer and significantly enhances the intrinsic value of the amorphous alloys as a power magnetic core material.

The long range thermal stability can be approximated by accelerated aging as discussed by Datta et al. in the Proceedings of a Symposium on "Chemistry and Physics of Rapidly Solidified Materials" held at St. Louis, Mo., Oct. 26–27, 1982 by the Metallurgical Society of AIME. Acceleration aging consists of estimating change in important soft magnetic properties (e.g., % change in VA at 1.4 T/60 Hz) of prototype cores exposed to temperatures higher than normal operating temperatures and extrapolating the change in properties to operating temperatures. FIG. 1 is a graph comparing accelerated aging (i.e., thermal stability) behavior (i.e., percent changes 1.4 T 60 Hz exciting power as a function of iron content) for Fe-B-Si containing alloys within and outside the scope of the invention. Aging was conducted at 240° C. for 2200 hrs. As illustrated by FIG. 1, alloys containing above about 79.8 atom percent iron experienced a substantial increase in exciting power (i.e., were aged significantly). Advantageously, each of the elevated temperature saturation induction and thermal stability were simultaneously optimized for alloys within the scope of the invention having iron content ranging from above about 79.4 to 79.8.

When cores comprising the subject alloys are utilized in electromagnetic devices, such as transformers, they evidence exceedingly high magnetization, low core loss and low volt-ampere demand, thus resulting in more efficient operation of the electromagnetic device. The loss of energy in a magnetic core as the result of eddy currents, which circulate through the core, results in the dissipation of energy in the form of heat. Cores made from the subject alloys require less electrical energy for operation and produce less heat. In applications where cooling apparatus is required to cool the transformer cores, such as transformers in aircraft and large power transformers, an additional savings is realized since less cooling apparatus is required to remove the smaller amount of heat generated by cores made from the subject alloys. In addition, the exceedingly high magnetization and high efficiency of cores made from the subject alloys result in cores of reduced weight for a given capacity rating.

The following examples are presented to provide a more complete understanding of the invention. The specific techniques, conditions, materials, proportions and reported data set forth to illustrate the principles and practice of the invention are exemplary and should not be construced as limiting the scope of the invention.

EXAMPLES

Toroidal test samples were prepared by winding approximately 0.030 kg of 0.0254 m wide alloy ribbon of various compositions containing iron, silicon and boron on a steatite core having inside and outside diameters of 0.0397 m and 0.0445 m, respectively. One hundred and fifty turns of high temperature magnetic wire were wound on the toroid to provide a D.C. circumferential field of 795.8 ampere/meter for annealing purposes. The samples were annealed in an inert gas atmosphere for 2 hours at a temperature ranging from 340° C. to 440° C. with the 795.8 A/m field applied during heating and cooling to determine the optimum field annealing conditions for each composition. The optimum field annealing condition for each composition is that at which the exciting power of the core is lowest. The samples were cooled at a rate of approximately 10° C./min.

The AC magnetic properties, i.e., power loss (watts/kilogram) and exciting power (RMS Volt-amperes/kilogram), of the samples were measured at a frequency of 60 Hz and a magnetic intensity of 1.4 Tesla by the sine-flux method.

Field annealed AC magnetic values for a variety of alloy compositions that are within the scope of the present invention are shown in Table I.

TABLE I

FIELD ANNEALED AC MAGNETIC MEASUREMENTS FOR AMORPHOUS METAL ALLOYS WITHIN THE SCOPE OF THE INVENTION

| | | | | AC Properties: 60 Hz, 1.4 T, 100° C. | | | |
|---|---|---|---|---|---|---|---|
| | | | | Before Aging | | After Aging at 240° C. For 2200 Hours | |
| | Composition | | | Power | Exciting | Power | Exciting |
| Example | Fe | B | Si | Loss | Power | Loss | Power |
| | (Atom %) | | | (w/kg) | (Va/kg) | (w/kg) | (Va/kg) |
| 1 | 79.4 | 13.5 | 7.1 | 0.217 | 0.417 | 0.198 | 0.429 |
| 2 | 79.5 | 13 | 7.5 | 0.220 | 0.331 | 0.221 | 0.312 |
| 3 | 79.6 | 13 | 7.4 | 0.218 | 0.321 | 0.203 | 0.317 |
| 4 | 79.8 | 12.5 | 7.7 | 0.236 | 0.327 | 0.255 | 0.361 |
| 5 | 79.8 | 14 | 6.2 | 0.218 | 0.388 | 0.239 | 0.437 |
| 6 | 79.8 | 13.5 | 6.7 | 0.248 | 0.418 | 0.271 | 0.467 |

For comparison, the compositions of some amorphous metal alloys lying outside the scope of the invention and their field annealed AC measurements are listed in Table II. These alloys, in contrast to those within the scope of the present invention, have higher core loss and higher volt-ampere demand at room temperature and at 100° C.

TABLE II

FIELD ANNEALED AC MAGNETIC MEASUREMENTS FOR AMORPHOUS METAL ALLOYS NOT WITHIN THE SCOPE OF THE INVENTION

| | | | | AC Properties: 60 Hz, 1.4 T, 100° C. | | | |
|---|---|---|---|---|---|---|---|
| | | | | Before Aging | | After Aging at 240° C. For 2200 Hours | |
| | Composition | | | Power | Exciting | Power | Exciting |
| Example | Fe | B | Si | Loss | Power | Loss | Power |
| | (Atom %) | | | (w/kg) | (VA/kg) | (w/kg) | (VA/kg) |
| 7 | 78 | 13 | 9 | 0.263 | 1.03 | 0.257 | 1.11 |
| 8 | 78.4 | 11 | 10.6 | 0.381 | 2.91 | 0.427 | 3.33 |
| 9 | 78.8 | 12.5 | 8.7 | 0.201 | 0.798 | 0.217 | 0.813 |
| 10 | 79 | 13 | 8 | 0.210 | 0.637 | 0.201 | 0.641 |
| 11 | 79.2 | 13 | 7.8 | 0.220 | 0.601 | 0.213 | 0.583 |
| 12 | 80 | 11 | 9 | 0.390 | 1.77 | 0.339 | 2.30 |

To illustrate the improved saturation induction of alloy compositions of the present invention at elevated temperatures, each of sample 1–6 from Table I was further tested by exciting each sample with an 8000 A/m drive field at 100° C. The improved saturation induction of the alloys thus tested is shown in Table III.

TABLE III

SATURATION INDUCTION OF AMORPHOUS METAL ALLOYS WITHIN THE SCOPE OF THE INVENTION

| Example | Composition Fe (Atomic %) | B | Si | Saturation Induction (T): 8000 A/m, 100° C. |
|---|---|---|---|---|
| 1 | 79.4 | 13.5 | 7.1 | 1.50 |
| 2 | 79.5 | 13 | 7.5 | 1.51 |
| 3 | 79.6 | 13 | 7.4 | 1.51 |
| 4 | 79.8 | 12.5 | 7.7 | 1.51 |
| 5 | 79.8 | 14 | 6.2 | 1.51 |
| 6 | 79.8 | 13.5 | 6.7 | 1.51 |

For comparison, the compositions of some amorphous metal alloys falling outside the scope of the invention and their saturation induction measurements at 8000 A/m drive field and 100° C. are set forth in Table IV.

TABLE IV

SATURATION INDUCTION OF AMORPHOUS ALLOYS OUTSIDE THE SCOPE OF THE INVENTION

| Example | Composition Fe (Atom %) | B | Si | Saturation Induction (T): 8000 A/m, 100° C. |
|---|---|---|---|---|
| 7 | 78 | 13 | 9 | 1.47 |
| 8 | 78.4 | 11 | 10.6 | 1.48 |
| 9 | 78.8 | 12.5 | 8.7 | 1.50 |
| 10 | 79 | 13 | 8 | 1.50 |
| 11 | 79.2 | 13 | 7.8 | 1.50 |

TABLE IV-continued

SATURATION INDUCTION OF AMORPHOUS ALLOYS OUTSIDE THE SCOPE OF THE INVENTION

| Example | Composition Fe (Atom %) | B | Si | Saturation Induction (T): 8000 A/m, 100° C. |
|---|---|---|---|---|
| 12 | 80 | 11 | 9 | 1.49 |

Having thus described the invention in rather full detail, it will be understood that this detail need not be strictly adhered to but that further changes and modifications may suggest themselves to one skilled in the art, all falling within the scope of the present invention as defined by the subjoined claims.

What is claimed is:

1. A metal alloy which is at least 90% amorphous consisting essentially of a composition having the formula $Fe_aSi_bB_c$ wherein "a", "b" and "c" are atomic percentages ranging from about 79.4 to 79.8, 6 to 8 and 12 to 14, respectively, with the proviso that the sum of "a", "b" and "c" equals 100, said alloy having a power loss of less than about 0.3 W/kg, measured at 60 Hz and 1.4T at 100° C., and an exciting power not greater than about 0.47 VA/kg, measured at 60 Hz and 1.4% at 100° C.

2. An amorphous metal alloy as recited in claim 1, wherein said alloy is at least about 97% amorphous.

3. An amorphous metal alloy as recited in claim 1, wherein said alloy is 100% amorphous.

4. An amorphous metal alloy as recited in claim 1, wherein "a" and "c" are 79.5 to 79.7 and 13 respectively, the balance being silicon.

5. An amorphous metal alloy as recited in claim 1, wherein said alloy has the form of a ribbon.

6. A amorphous metal alloy core as recited in claim 10, wherein said core is in the form of a toroid.

* * * * *

UNITED STATES PATENT AND TRADEMARK OFFICE

CERTIFICATE OF CORRECTION

PATENT NO. : 5,035,755

DATED : July 30, 1991

INVENTOR(S) : David M. Nathasingh, et al.

It is certified that error appears in the above-identified patent and that said Letters Patent is hereby corrected as shown below:

Col. 8, line 25, change "1.4%" to --1.4T--.

Col. 8, after line 33, insert the following:

--6. For use in an electromagnetic device, a core comprising a metal alloy which is at least 90% amorphous consisting essentially of a composition having the formula $Fe_aSi_bB_c$ wherein "a", "b" and "c" are atomic percentages ranging from about 79.4 to 79.8, 6 to 8 and 12 to 14, respectively, with the proviso that the sum of "a", "b" and "c" equals 100, said alloy exhibiting a power loss of less than about 0.3 W/kg (measured at 60 Hz and 1.4T) and an exciting power not greater than about 0.47 VA/kg, measured at 60 Hz and 1.4T at 100°C.--

Col. 8, line 36, change "6" to --7--.

Col. 8, line 37, change "10" to --6--.

Signed and Sealed this

Twenty-third Day of March, 1993

*Attest:*

STEPHEN G. KUNIN

*Attesting Officer*

*Acting Commissioner of Patents and Trademarks*